US006104889A

United States Patent [19]

Saitoh

[11] Patent Number: 6,104,889

[45] Date of Patent: Aug. 15, 2000

[54] AUTOMATIC COMPONENT REPLACEMENT DETECTING SYSTEM IN AN IMAGE FORMING APPARATUS

[75] Inventor: Seiji Saitoh, Yokohama, Japan

[73] Assignee: Ricoh Company, Ltd., Tokyo, Japan

[21] Appl. No.: 09/287,195

[22] Filed: Apr. 6, 1999

[30] Foreign Application Priority Data

Apr. 6, 1998 [JP] Japan ..... 10-093320

[51] Int. Cl.[7] ..... G03G 15/00

[52] U.S. Cl. ..... 399/12; 399/33

[58] Field of Search ..... 399/12, 13, 24, 399/122, 33; 340/638, 639, 652

[56] References Cited

U.S. PATENT DOCUMENTS

| | | | |
|---|---|---|---|
| 4,551,000 | 11/1985 | Kanemitsu et al. | 399/111 |
| 4,585,327 | 4/1986 | Suzuki | 399/26 |
| 5,038,173 | 8/1991 | Kusumoto | 399/13 |
| 5,066,978 | 11/1991 | Watarai et al. | 399/24 |
| 5,311,253 | 5/1994 | Ohmori et al. | 399/13 |
| 5,722,012 | 2/1998 | Saitoh | 399/99 |

FOREIGN PATENT DOCUMENTS

| | | |
|---|---|---|
| 61-083570 | 4/1986 | Japan . |
| 63-271489 | 11/1988 | Japan . |
| 3-087845 | 4/1991 | Japan . |
| 9-185288 | 7/1997 | Japan . |
| 9-244485 | 9/1997 | Japan . |

*Primary Examiner*—Robert Beatty

*Attorney, Agent, or Firm*—Oblon, Spivak, McClelland, Maier & Neustadt, P.C.

[57] ABSTRACT

A system for detecting replacement of a replaceable fixing device in an image forming apparatus, including providing the replaceable fixing device with a roller, and detecting via a detecting device whether or not the fixing device is replaced based on a rotation of the roller. The detecting device includes an electrical connector having electrical contacts. The electrical contacts are maintained in a contact position when the replaceable fixing device is first replaced. Rotation of the roller causes the electrical contacts to be released from the contact position which is detected by the detecting means for detecting that the fixing device is replaced.

11 Claims, 6 Drawing Sheets

AUTOMATIC COMPONENT REPLACEMENT DETECTING SYSTEM IN AN IMAGE FORMING APPARATUS

BACKGROUND OF THE INVENTION

1. Field of the Invention

The present invention relates to image forming devices, and more particularly to an image forming device including a fixing device that affixes toner, or another image forming substance, to a sheet so as to make a toner image on the sheet.

2. Discussion of the Background

A conventional image forming apparatus, such as an electrostatic copying machine, printer, facsimiles, etc., which employs an electrophotography process, also typically includes a fixing device for fixing a toner image on a transfer paper. A conventional fixing device includes a heating roller having a heating element therein and a press roller that contacts the heating roller.

The fixing device in general is treated a consumable article so that a life cycle thereof is shorter than that of the image forming apparatus itself. Accordingly, the fixing device is required to be periodically replaced.

In addition, the conventional image forming apparatus includes counters, provided in the main body thereof to count, for example, a number of copies made (i.e., copy volume) in order to determine life cycles of parts of the image forming apparatus, such as a main body, a photosensitive device, a fixing device, etc. In such an image forming apparatus, for example, when replacing a used fixing device with a new fixing device, an operator or a serviceman has to manually reset a counter provided for determining the life cycle of the fixing device. More specifically, a switch is provided in the main body of the image forming apparatus and the operator or serviceman pushes the switch to reset the counter.

However, in above-mentioned fixing device replacement system for the image forming apparatus, the system complexity and a cost increases due to the counters and related circuitry. Furthermore, as this system requires manual operation by the operator or the serviceman, human error is introduced, for example, if the operator or serviceman forgets to reset the counter when replacing the fixing device leading to an incorrect life cycle determination.

SUMMARY OF THE INVENTION

Accordingly, it is an object of the present invention to provide a novel method, system and computer readable medium for automatically detecting replacement of a replaceable fixing device in an image forming apparatus.

Another object of the present invention to provide a novel method, system and computer readable medium for automatically detecting replacement of a replaceable fixing device in an image forming apparatus with decreased cost and reduction of human error.

The above and other objects are achieved according to the present invention by providing a new and improved method, system and computer readable medium for detecting replacement of a replaceable fixing device in an image forming apparatus, including providing the replaceable fixing device with a roller, and detecting via a detecting device whether or not the fixing device is replaced based on a rotation of the roller. The detecting device includes an electrical connector having electrical contacts. The electrical contacts are maintained in a contact position when the replaceable fixing device is first replaced. Rotation of the roller causes the electrical contacts to be released from the contact position which is detected by the detecting means for detecting that the fixing device is replaced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
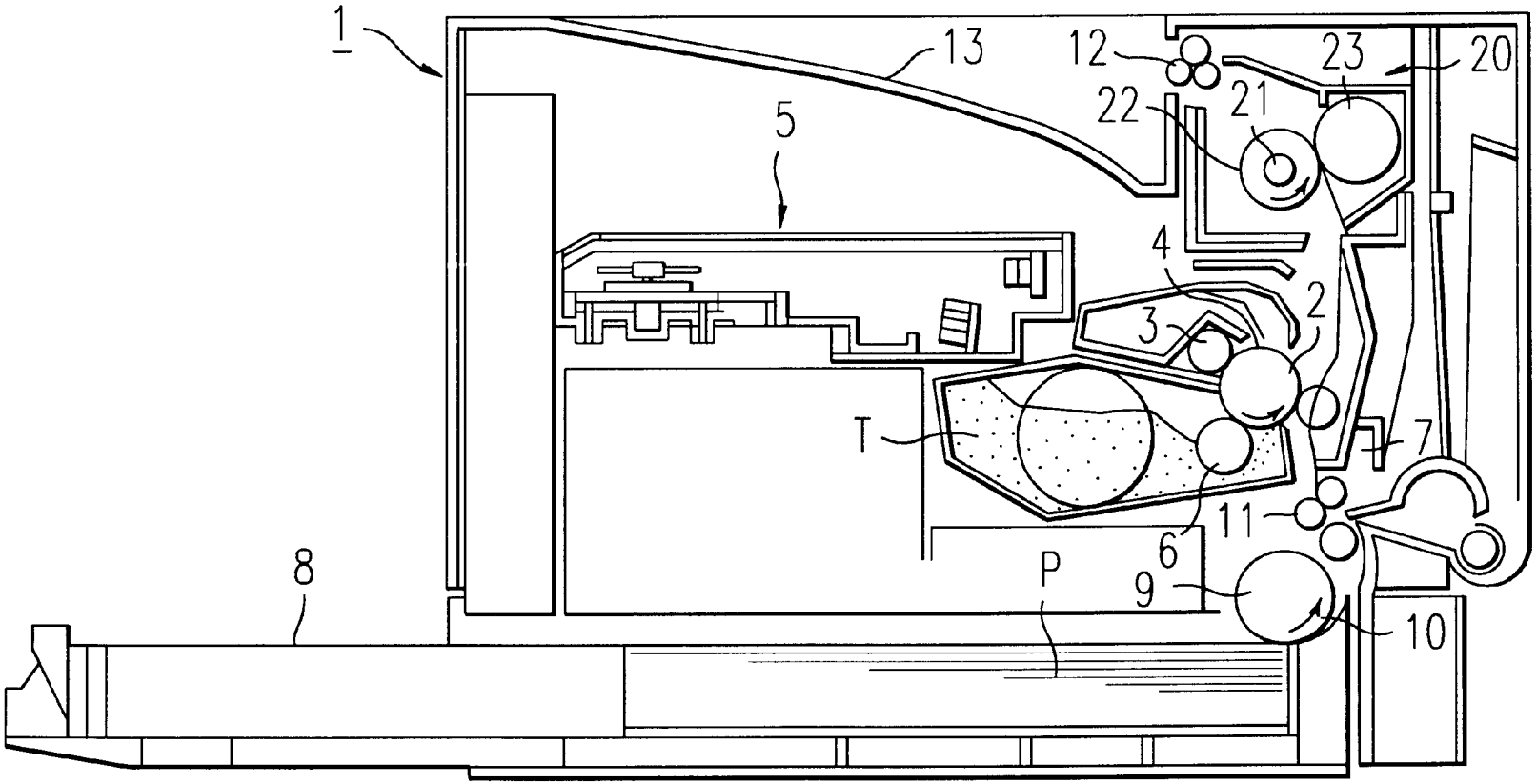
FIG. 1 is a cross-sectional view of a fixing apparatus including an inductive heating roller according to the present invention.

While the present invention will hereinafter be described in connection with preferred embodiments thereof, it will be understood that it is not intended to limit the invention to these embodiments. On the contrary, it is intended to cover all alternatives, modifications and equivalents wherein the spirit and scope of the invention are included. Furthermore, in the drawings, like reference numerals have been used throughout the drawings to identify identical elements.

Referring to FIG. 1, which conceptually shows a laser beam printer system including a main body 1, a photosensitive body 2, a charger 3, cleaning device 4, a laser writing device 5, a developing device 6, and a transfer device 7, all of which are located around the photosensitive body 2.

In this laser beam printer system, a paper-supplying cassette 8 is removably provided in the main body 1. The uppermost recording paper P is supplied from the paper-supplying cassette 8 to registration rollers 11 by a pick up roller 9 and separation pad 10, the leading edge of the recording paper thus engaging with the registration rollers 11. The recording sheet is in a standby state wherein the leading edge thereof engages with the registration rollers 11. In addition, a laser beam emitted from the laser writing device 5 scans the photosensitive body 2 so that an electrostatic latent image corresponding to image data is formed on a surface of the photosensitive body 2. Then, the electrostatic latent image is developed by the developing device 6 so that visible image formed of toner is obtained. The toner image formed on the surface of the photosensitive body 2 is moved toward a transfer device 7 due to a rotation of the photosensitive body 2.

The recording paper which is in the standby position at the registration rollers 11 described above is fed between the photosensitive body 2 and the transfer device 7 by the registration rollers 11 when the toner image is transferred to the paper, so that the image is formed on the paper.

The fixing device 20 is made in a single-piece construction and includes a heating roller 22 having a heater 21, and a pressure roller 23 for pressing against the heating roller 22, and forming a nip therebetween. As the heating roller 22 rotates, because of pressure applied thereon by the pressure roller 23, the pressure roller 23 also rotates. With the above-mentioned construction, the paper having the toner image thereon is fed through the nip at the same speed as of the transferring process wherein the toner image is fixed on the paper. The paper fixed with the toner image is then discharged by the discharging rollers 12 onto a tray 13 such that the printed surface is facing downward. Residual toner on the photosensitive body 2 is cleaned by the cleaning device 4 after the transferring process. Similarly, residual electrical charge is discharged by a discharging device (not shown). Furthermore, the laser beam printer system includes a microprocessor and ROM and RAM (not shown) programmed to execute that processes of the present invention.

Figure 2:
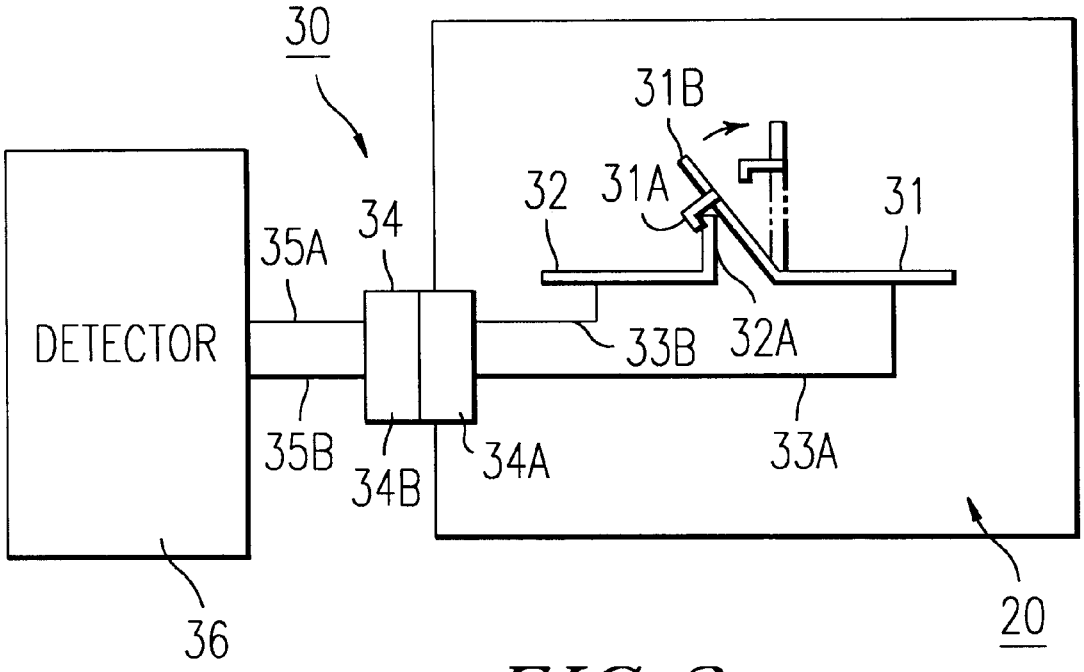
FIG. 2 is a schematic diagram illustrating a fixing device replacement detecting device according to the present invention.

FIG. 2 is a schematic diagram illustrating a replacement detecting device 30. The replacement detecting device 30 includes a first signal terminal 31 and a second signal terminal 32, and which are movably connected with each other as will be described. A lead wire 33A connects the first signal terminal 31 to a first connector 34A. Similarly, a lead wire 33B connects the second signal terminal 32 to the first connector 34A, wherein the wires 33A and 33B are engaged in the connector 34A. The terminals 31 and 32, wires 33A and 33B, and the first connector 34A are provided in the fixing device 20. When the fixing device 20 is inserted in the main body 1, the first connector 34A is engaged a second connector 34B. The second connector 34B is provided in the main body 1 and includes lead wires 35A and 35B connecting the second connector 34B to a detector 36. The detector 36 functions to reset a number of copies counted (i.e., copy volume) by a fixing device counter (not shown). The connectors 34A and 34B function to transfer a signal indicating a connection between the first signal terminal 31 and the second signal terminal 32. In addition to this function, the connectors 34A and 34B function to transfer signals for heat control and existence of copy paper.

More specifically, the first signal terminal 31 and the second signal terminal 32 are kept in contact (i.e., an "ON" condition), as shown by the solid lines, when the fixing device 20 is a brand new (i.e., newly replaced). As the fixing device 20 is inserted in the main body 1, the detector 36 recognizes this "ON" condition through the first and second connectors 34A and 34B and signal lines 33A and 33B. Then, based on this "ON" condition, a fixing counter provided in the main body 1 is reset indicating that the fixing device 20 is newly replaced.

After the above recognition of the "ON" condition by the detector 36, when the main body 1 is driven, and the heating roller 22 and the pressure roller 23 rotate, the first signal terminal 31 separates from the second signal terminal 32 (i.e., an "OFF" condition), as shown by the dotted lines. The fixing counter then starts to count the number of copies made (i.e., copy volume) after the detector 36 recognizes the "OFF" condition.

Figure 3:
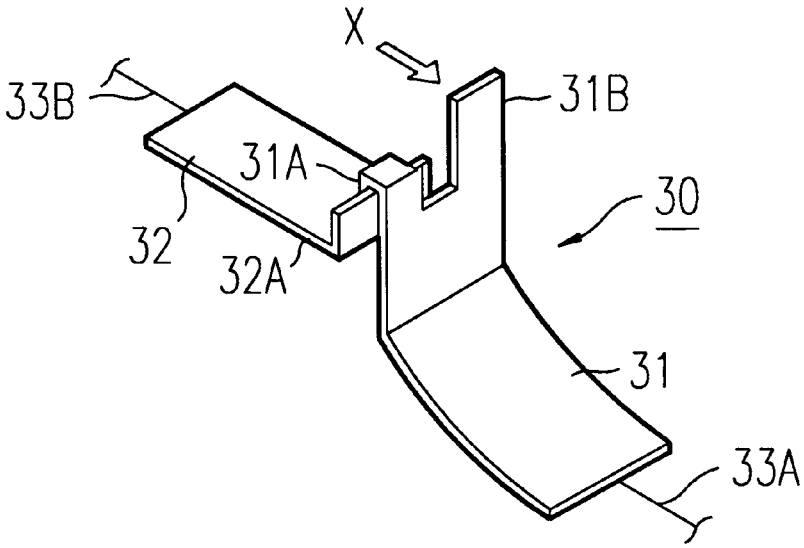
FIGS. 3 and 4 are schematic diagrams illustrating details of the fixing device replacement detecting device of FIG. 2 in ON" and "OFF" positions according to the present invention.
Figure 4:
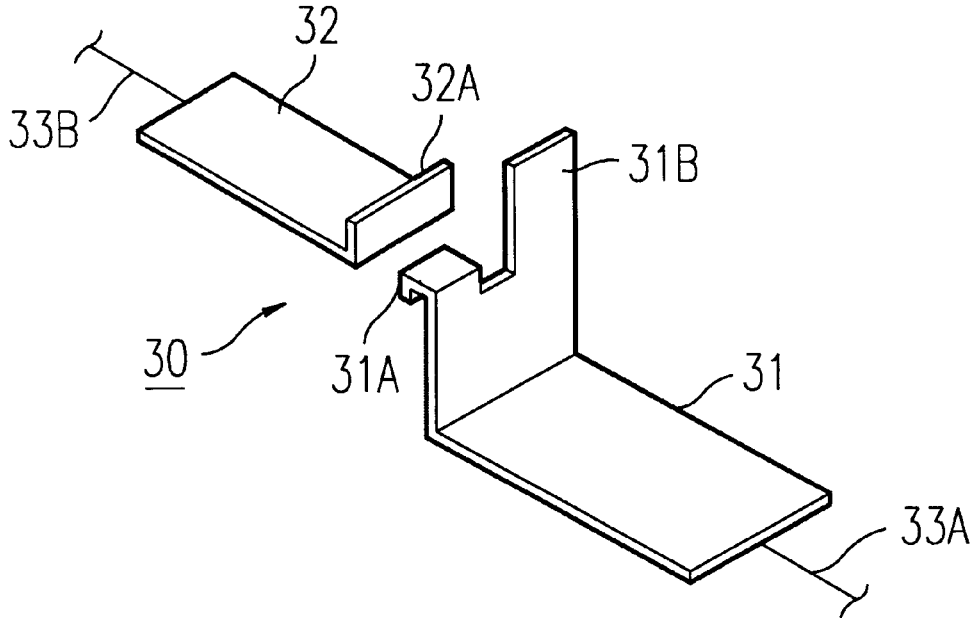

FIGS. 3 and 4 are schematic diagrams illustrating details of the fixing device replacement detecting device of FIG. 2 in ON" and "OFF" positions according to the present invention. In FIG. 3, the first signal terminal 31 includes a hook portion 31A and a moving portion 31B. When the fixing device 20 is newly replaced, the hook portion 31A is hooked on a vertical portion 32A of the second signal terminal 32 indicating the "ON" condition. When an external force X acts to the moving portion 31B, as shown in FIG. 3, the hook portion 31A is separated from the vertical portion 32A indicating the "OFF" condition, as shown in FIG. 4, and the detector 36 recognizes this "OFF" condition as previously described.

Figure 5:
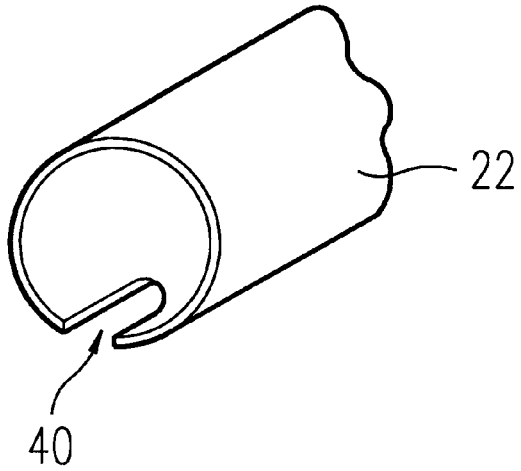
FIG. 5 is a schematic diagram illustrating details of a heating roller for the fixing device replacement detecting device of FIG. 2 according to the present invention.
Figure 6:
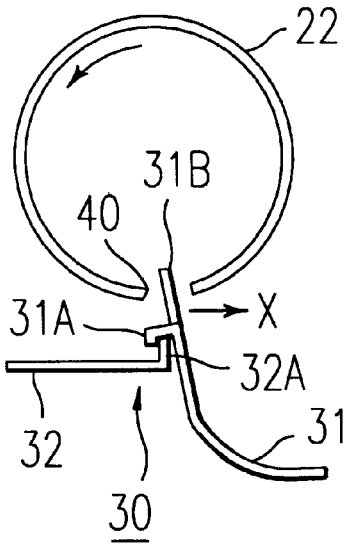
FIGS. 6 and 7 are schematic diagrams illustrating details of the operation of the heating roller and the fixing device replacement detecting device according to the present invention.
Figure 7:
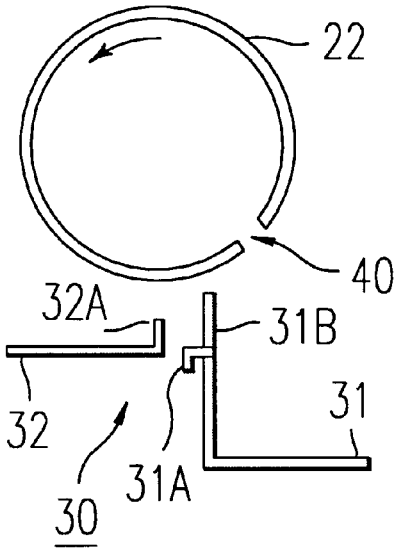

In FIG. 5, the heating roller 22 includes a notch 40 at an end thereof and the moving portion 31B is inserted in the notch 40 and is in contact with the portion 32A indicating the "ON" condition, as shown in FIG. 6, and as recognized by the detector 36 as previously described. When the heating roller 22 rotates in the direction of arrows, the heating roller 22 generates the external force X to separate the first signal terminal 31 from the second signal terminal 32. Accordingly, as the first signal terminal 31 is separated from the second signal terminal 32 by the external force X and is maintained in this separated position as the "OFF" condition, the detector 36 recognizes this "OFF" condition as previously described. The first signal terminal 31 is then kept in a folded condition, as shown in FIG. 7, and indicating the "OFF" condition.

Figure 8:
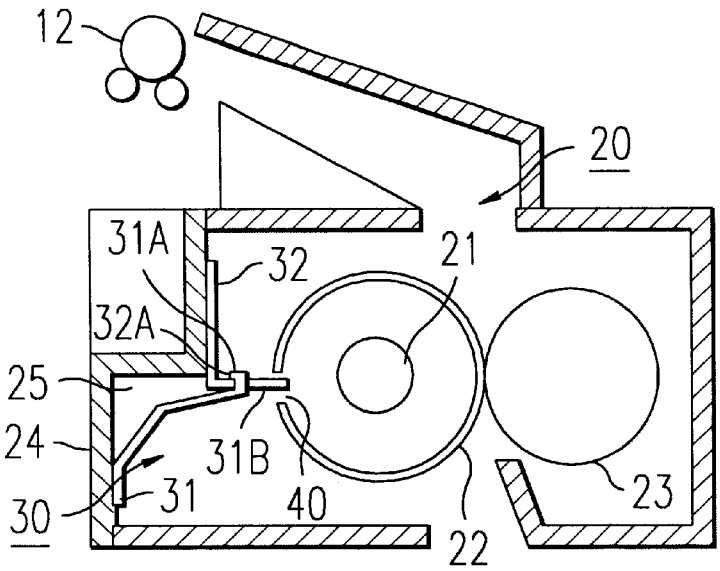
FIGS. 8 and 9 are schematic diagrams illustrating details of assembly of the heating roller and the fixing device replacement detecting device in the fixing device according to the present invention.
Figure 9:
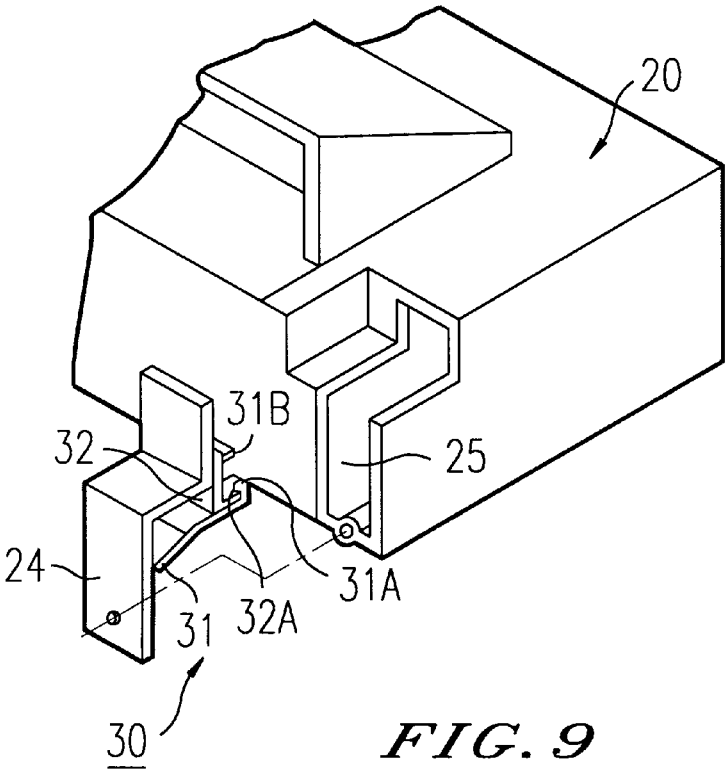

FIGS. 8 and 9 are schematic diagrams illustrating details of assembly of the heating roller 22 and the fixing device replacement detecting device 30 in the fixing device 20 according to the present invention. In FIGS. 8 and 9, the first signal terminal 31 and the second signal terminal 32 are previously set in a holder 24 in the "ON" condition. The holder 24, is then inserted in an opening 25 of the fixing device 20 and secured with the fixing device by a setscrew (not shown).

In addition, in another embodiment, the first signal terminal 31 and the second signal terminal 32 are included directly in the fixing device 20. However, in this case, it is necessary to set the first signal terminal 31 and the second signal terminal 32 to the "ON" condition before installing the heating roller 22. Accordingly, in this case, reassembly of the terminals 31 and 32 may be difficult, for example, if the terminals 31 and 32 are separated to the "OFF" condition during assembly. Furthermore, it may be impossible to make rotational tests of the fixing device 20 before installing the fixing device 20 in the main body 1, because the heating roller 22 must not be rotated or else the "ON" condition cannot be maintained.

On the other hand, in the previous embodiment, since the signal terminals 31 and 32 are provided in the holder 24 that is separable from a casing of the fixing device 20, it is possible to set the holder 24 to the "ON" condition during final assembly. Accordingly, separation of the terminals 31 and 32 during assembly of other components, such as the heating roller 22, the pressure roller 23, etc., is not a problem. Furthermore, installing the holder 24 after making rotational tests of the fixing device 20 before installing the fixing device 20 in the main body 1 is possible while still maintaining the "ON" condition. Still further, not providing the holder 24 to a fixing device 20 initially installed but only to a fixing device 20 newly replaced reduces the cost of the image forming apparatus. This is because a fixing device initially installed is regarded as a virgin medium.

Figure 10:
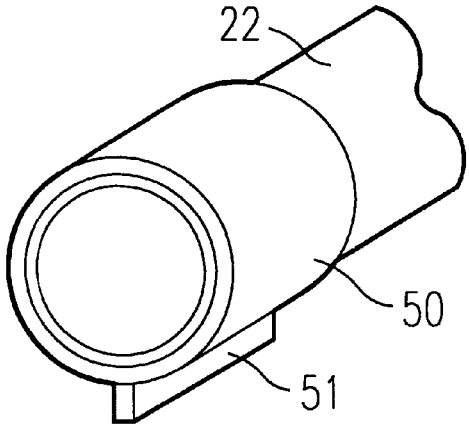
FIGS. 10 and 11 are schematic diagrams illustrating details of the operation of the heating roller and the fixing device replacement detecting device according to another embodiment of the present invention.
Figure 11:
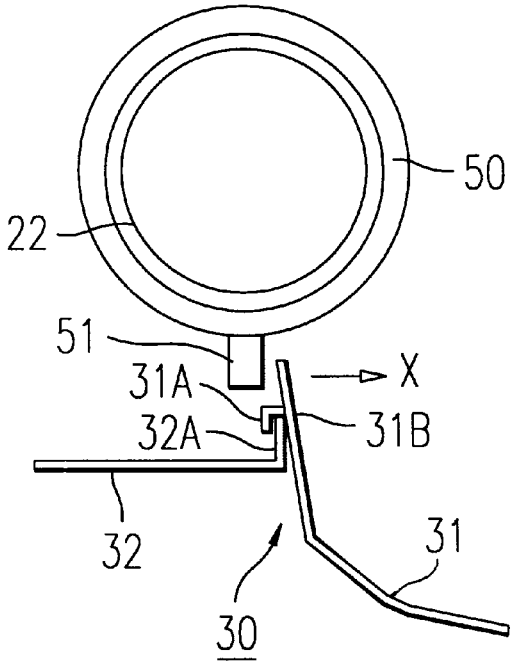

FIGS. 10 and 11 are schematic diagrams illustrating details of the operation of the heating roller 22 and the fixing device replacement detecting device 30 according to another embodiment of the present invention. In FIG. 10, a lever ring 50 having a protrusion 51 is provided at an edge of the heating roller 22. As the lever ring 50 rotates with rotation of the heating roller 22, an external force X, as shown in FIG. 6, is generated to separate the first signal terminal 31 from the second signal terminal 32. Accordingly, as the first signal terminal 31 is separated from the second signal terminal 32 by the external force X and remains in this separated position, the detector 36 recognizes the "OFF" condition. In this embodiment, an assembly of the fixing device is improved because there is need to insert the moving portion 31B into the notch 40 of the previous embodiment shown in FIG. 5.

In above-mentioned embodiments, when the notch 40 or the protrusion 51 is made of thermal and electrical insulating resin, a short circuit or miss detection of the replacement detecting device is prevented.

The mechanisms and processes set forth in the present description may be implemented using a conventional general purpose microprocessor programmed according to the teachings in the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a microprocessor to perform a process in accordance with the present invention. This storage medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

This document claims priority and contains subject matter related to Japanese patent application No. 10/93,320 filed in the Japanese patent Office on Apr. 6, 1998, the entire contents of which are hereby incorporated by reference.

What is claimed as new and is desired to be secured by Letters Patents of the United States:

1. An image forming apparatus, comprising:

a replaceable fixing device including a roller; and a detecting means for detecting whether or not said fixing device is replaced based on a rotation of said roller;

wherein said detecting means includes an electrical connector having electrical contacts;

said electrical contacts of said electrical connector are maintained in a contact position when said replaceable fixing device is first replaced; and rotation of said roller causes said electrical contacts of said electrical connector to be released from said contact position which is detected by said detecting means for detecting that said fixing device is replaced.

2. The apparatus of claim 1, wherein said electrical contacts of said connector include a moving part inserted in a notch provided in said roller for mechanically releasing said contact position.

3. The apparatus of claim 1, wherein said electrical contacts of said connector include a moving part and said roller is provided with a protrusion located at a respective position of said moving part for mechanically releasing said contact position.

4. The apparatus of claim 1, wherein said connector is provided in a holder removably replaceable from a casing of said fixing device.

5. The apparatus of claim 4, wherein said holder is provided only in a replacement fixing device.

6. A method for detecting replacement of a replaceable fixing device in an image forming apparatus, comprising the steps of:

providing said replaceable fixing device including a roller;

detecting whether or not said fixing device is replaced based on a rotation of said roller;

providing an electrical connector having electrical contacts;

maintaining said electrical contacts of said electrical connector in a contact position when said replaceable fixing device is first replaced; and releasing said electrical contacts of said electrical connector from said contact position upon rotation of said roller for detecting that said fixing device is replaced.

7. The method of claim 6, further comprising:

providing a moving part in said electrical contacts of said connector; and inserting said moving part in a notch provided in said roller for mechanically releasing said contact position.

8. The method of claim 6, further comprising:

providing a moving part in said electrical contacts of said connector; and providing a protrusion located at a respective position of said moving part in said roller for mechanically releasing said contact position.

9. The method of claim 6, further comprising:

providing said connector in a holder removably replaceable from a casing of said fixing device.

10. The method of claim 9, further comprising:

providing said holder only in a replacement fixing device.

11. A computer readable medium storing computer instructions for detecting replacement of a replaceable fixing device having a roller in an image forming apparatus, by performing the step of:

detecting whether or not said fixing device is replaced based on a rotation of said roller;

detecting that electrical contacts of an electrical connector provided in said replaceable fixing device are maintained in a contact position when said replaceable fixing device is first replaced; and detecting a releasing of said electrical contacts of said electrical connector from said contact position upon rotation of said roller for detecting that said fixing device is replaced.

* * * * *